US009611710B2

(12) United States Patent
Looijen

(10) Patent No.: US 9,611,710 B2
(45) Date of Patent: Apr. 4, 2017

(54) METHOD, HANDLING UNIT AND STAND FOR ACQUIRING A SAMPLE FROM A SEABED TOP LAYER

(71) Applicant: Fugro Engineers B.V., Leidschendam (NL)

(72) Inventor: Peter Looijen, Leidschendam (NL)

(73) Assignee: Fugro Engineers B.V., Leidschendam (NL)

( * ) Notice: Subject to any disclaimer, the term of this patent is extended or adjusted under 35 U.S.C. 154(b) by 0 days.

(21) Appl. No.: 14/555,117

(22) Filed: Nov. 26, 2014

(65) Prior Publication Data

US 2015/0337611 A1 Nov. 26, 2015

(30) Foreign Application Priority Data

May 26, 2014 (NL) ..... 2012885

(51) Int. Cl.

| | |
|---|---|
| ***E21B 25/18*** | (2006.01) |
| ***E21B 7/12*** | (2006.01) |
| ***E21B 25/00*** | (2006.01) |
| ***E21B 49/02*** | (2006.01) |

(52) U.S. Cl.

CPC ..... *E21B 25/18* (2013.01); *E21B 7/12* (2013.01); *E21B 25/005* (2013.01); *E21B 49/025* (2013.01)

(58) Field of Classification Search

CPC ..... E21B 25/00; E21B 25/005; E21B 25/04; E21B 25/10; E21B 25/14; E21B 25/18; E21B 19/155

USPC ..... 175/5, 8, 10, 58, 308, 336

See application file for complete search history.

(56) References Cited

U.S. PATENT DOCUMENTS

| | | | | |
|---|---|---|---|---|
| 2,638,321 | A * | 5/1953 | Isbell | E21B 7/1245 175/4 |
| 3,225,602 | A * | 12/1965 | Barton | E21B 25/18 175/5 |
| 3,345,879 | A * | 10/1967 | Nasu | E21B 7/1245 173/159 |
| 3,438,452 | A * | 4/1969 | Bernard | E21B 25/18 175/20 |
| 3,874,462 | A | 4/1975 | Harms et al. | |
| 4,143,720 | A | 3/1979 | Verdin | |
| 6,394,192 | B1 * | 5/2002 | Frazer | E21B 7/124 175/20 |
| 7,255,180 | B2 * | 8/2007 | Beato | E21B 15/00 173/28 |
| 9,145,737 | B2 * | 9/2015 | Kang | E21B 7/12 |

FOREIGN PATENT DOCUMENTS

| | | |
|---|---|---|
| GB | 1321919 | 7/1973 |

* cited by examiner

*Primary Examiner* — James G Sayre

(74) *Attorney, Agent, or Firm* — Peacock Myers, P.C.; Jeffrey Myers

(57) ABSTRACT

Handling unit equipped to acquire a sample from a seabed top layer by retracting and retrieving a piston corer holding the sample from a seabed, and to remove the sample from the piston corer, wherein the handling unit is a standalone unit arranged for mounting on a vessel and for retrieval of a sample from the piston corer while it remains vertical. The handling unit comprises a container with dimensions and/or lifting points and/or connections as provided on a standard sea freight container. It also comprises a lifting device which is foldable out of and back into a container of the handling unit.

23 Claims, 12 Drawing Sheets

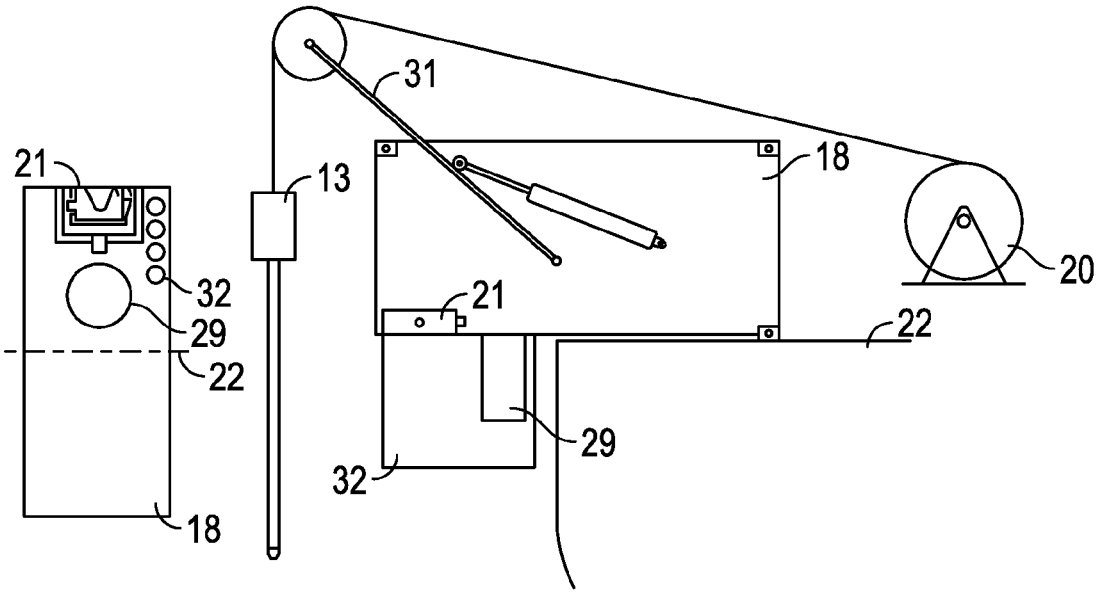
FIG. 2A
FIG. 2B
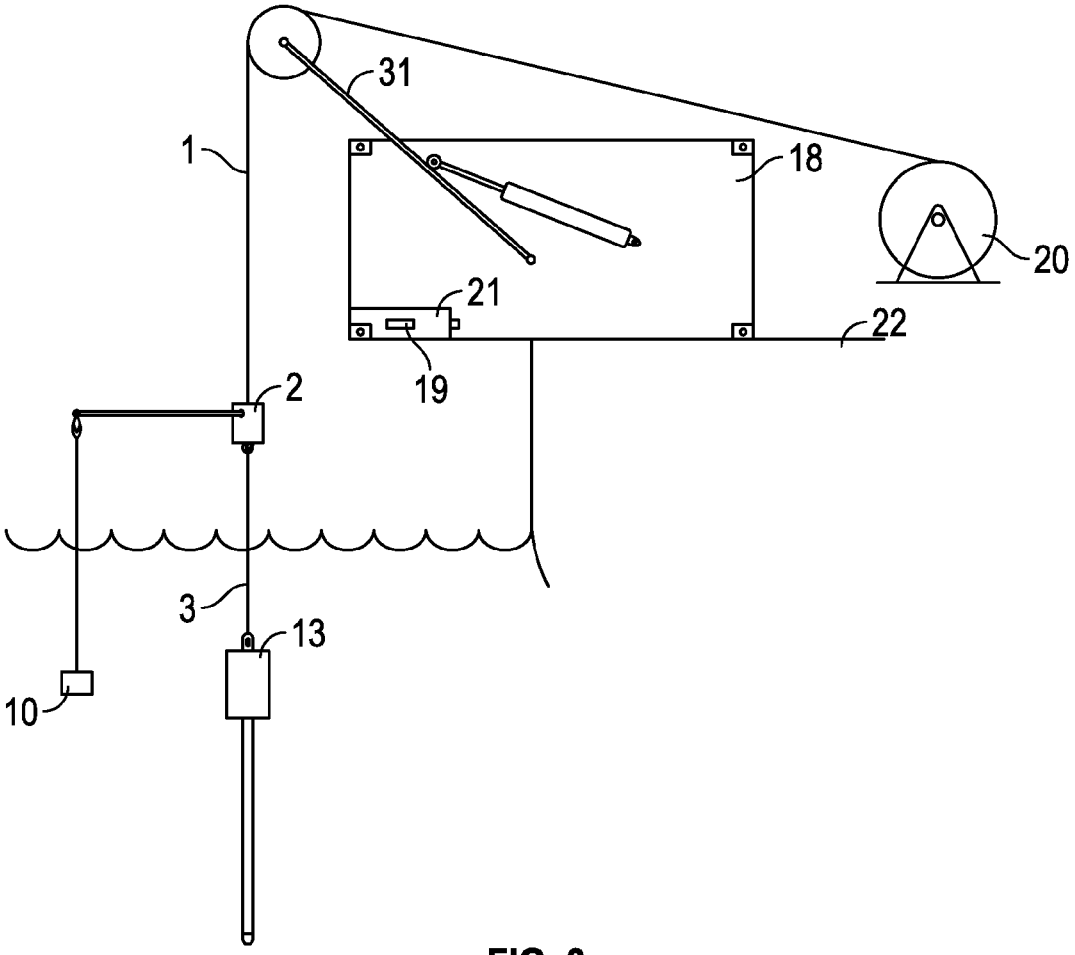
FIG. 3

METHOD, HANDLING UNIT AND STAND FOR ACQUIRING A SAMPLE FROM A SEABED TOP LAYER

CROSS-REFERENCE TO RELATED APPLICATIONS

This application claims priority to and the benefit of the filing of Netherlands Patent Application No. 2012885, filed on May 26, 2014, and the specification and claims thereof are incorporated herein by reference.

STATEMENT REGARDING FEDERALLY SPONSORED RESEARCH OR DEVELOPMENT

Not Applicable.

INCORPORATION BY REFERENCE OF MATERIAL SUBMITTED ON A COMPACT DISC

Not Applicable.

COPYRIGHTED MATERIAL

Not Applicable.

BACKGROUND OF THE INVENTION

Field of the Invention (Technical Field)

The present invention relates to a method, a handling unit, and a stand that are all used to acquire a sample from a seabed top layer by retracting and retrieving a piston corer holding the sample from the seabed, and to remove said sample from the piston corer.

Description of Related Art

It is known from the day to day practice of acquiring a sample from a seabed top layer, to employ the steps of: introducing a piston corer suspended from a floating vessel vertically into the seabed; retracting the piston corer from the seabed and retrieving it on a deck of the floating vessel; and removing the sample from the piston corer.

In order to remove the sample from the piston corer, the piston corer is transferred from its vertical orientation in which it is retracted from the seabed to a horizontal orientation on deck of the vessel. For this purpose conventionally a support construction, also known as stinger, is used in case the barrels of the piston corer have a joint length such that it cannot support itself, which is typically length beyond 8 m. To employ the known stinger for this purpose and to arrange that the piston corer can be transferred from a vertical to a horizontal orientation (and vice versa), a vessel supporting the stinger is to be employed with certain minimum dimensions. Also only specific locations on the vessel can be used in order to be able to position the various support constructions that are required and to be able to access the piston corer for removal of the liner and to prepare the corer for a new cycle. Typically for acquiring a 30 m sample from the seabed, the vessel must have a length of 80-90 m to handle the piston corer efficient and safely.

The present invention is aimed at alleviating and/or obviating the restrictions that are associated with the prior art solutions.

BRIEF SUMMARY OF THE INVENTION

The present invention is of a method, a handling unit, and a stand that are all used to acquire a sample from a seabed top layer by retracting and retrieving a piston corer holding the sample from the seabed, and to remove said sample from the piston corer.

Further scope of applicability of the present invention will be set forth in part in the detailed description to follow, taken in conjunction with the accompanying drawings, and in part will become apparent to those skilled in the art upon examination of the following, or may be learned by practice of the invention. The objects and advantages of the invention may be realized and attained by means of the instrumentalities and combinations particularly pointed out in the appended claims.

BRIEF DESCRIPTION OF THE SEVERAL VIEWS OF THE DRAWINGS

The accompanying drawings, which are incorporated into and form a part of the specification, illustrate one or more embodiments of the present invention and, together with the description, serve to explain the principles of the invention. The drawings are only for the purpose of illustrating one or more preferred embodiments of the invention and are not to be construed as limiting the invention. In the drawings:

FIGS. 2A and 2B show a handling unit according to the invention;

FIG. 3 shows a general overview of applying the handling unit of FIGS. 2A and 2B in combination with the piston corer of FIG. 1;

DETAILED DESCRIPTION OF THE INVENTION

Figure 1:
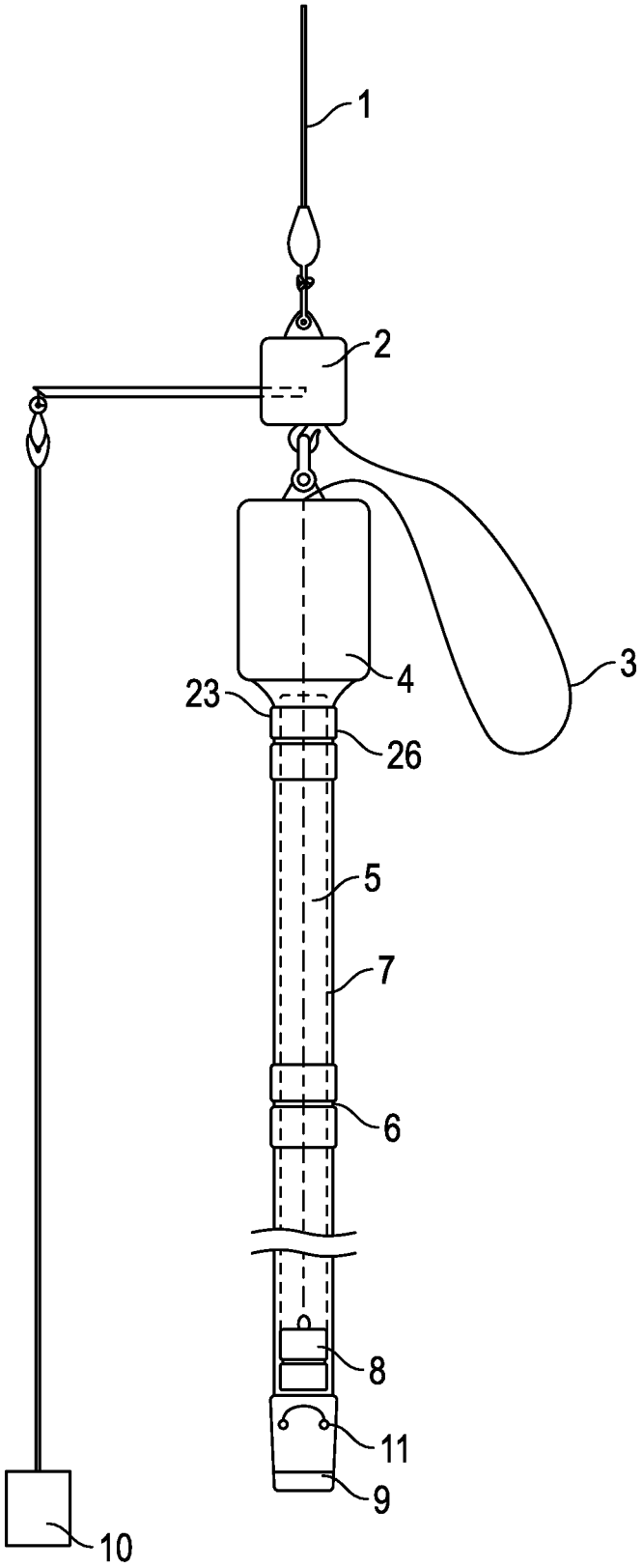
FIG. 1 (PRIOR ART)
FIG. 1 shows a large diameter piston corer.

In one aspect of the invention the sample is removed from the piston corer after the said piston corer is retracted from the seabed and while said piston corer is still in its vertical position suspended from the floating vessel. This has the advantage that the sample length is independent from the vessel length, and that the location on the vessel of the handling unit which is employed to retrieve the sample from the piston corer is hardly critical so that multiple locations on the vessel may be used, notably over the stern, over the side, or using a moonpool. Advantageously and corresponding to the foregoing the handling unit is preferably a standalone unit arranged for mounting on the vessel and arranged for retrieval of a sample from the piston corer while it remains vertical.

In another aspect of the invention the vessel is provided with at least two handling units according to the invention. Since the handling unit of the invention is arranged to retrieve a sample from the piston corer while it remains vertical, this means that in comparison with prior art solutions more space is available on the vessel, which can be effectively utilized. By using this free space for one or more further handling units according to the invention, the production time and associated costs in acquiring samples from the seabed can be tremendously reduced by having these handling units operate simultaneously and concertedly.

According to another aspect of the invention the handling unit comprises a container with dimensions and/or lifting points and/or connections as provided on a standard sea freight container. This makes the handling unit easily transportable.

There are several preferred embodiments in which the method of the invention can be executed.

In one preferred embodiment, wherein the piston corer comprises several barrels provided with a liner, the barrels are one by one disconnected from each other, each barrel comprising a liner part which is subsequently removed from the disconnected barrel. In this embodiment effective use can be made of a stand provided with an actuator, which actuator is provided with a head having a cap for placement at the liner of a barrel removed from a piston corer. This is an effective means to prevent distortion or loss of the sample in the barrel.

In another preferred embodiment, wherein the piston corer comprises several barrels provided with a liner, the liner is integrally removed from the barrels and cut into separate liner parts.

In both embodiments of the method of the invention special attention is required due to the barrels being vertically suspended from the floating vessel. This means that the sample moves according to the movements of the floating vessel and that each time the lowest barrel must be sealed at its bottom in order to: protect the sample due to vessel motion to prevent that the sample is washed out; to retain lateral support of the sample by the water inside the liner to prevent that the sample will collapse; and to vertically support the sample at the bottom of the corer to prevent that it will fall out when it's weight is higher than can be supported by the catcher at the bottom of the piston corer.

To promote the benefits of the invention the handling unit preferably comprises a lifting device to guide a lift wire coming from a winch on the vessel to transfer the load acting by the piston corer on the lift wire and transfer it into the vessel strong points.

Advantageously the lifting device is foldable out of and back into a container of the handling unit, and preferably the lifting device can boom in and out of the container to move the piston corer suspended therefrom in and outwards.

Also advantageously the handling unit comprises docking stations for storing barrels and a weight stand of the piston corer.

In one embodiment of the handling unit it is provided with a gimbal for suspending the piston corer, and thus effectively compensating for vessel motion and keep the piston corer vertical while the vessel is rolling and pitching. In this way the forces applied to the sample due to heave motion are minimized.

Preferred features of the method, handling unit, and stand are provided in the claims and in the following detailed description, wherein the invention will be further elucidated with reference to the drawing of exemplary embodiments that illustrate the invention and that is not limiting as to the appended claims.

With reference first to FIG. 1, a general overview of a large diameter piston corer or LDPC is given. An LDPC comprises a weight stand 4 that together with the fall velocity provides the required force to drive the barrels 5 of the piston corer into the soil. Lifting and lowering of the LDPC is done with a lift wire 1. A release mechanism 2 initiates the free-fall of the LDPC when the release mechanism weight 10 touches the seabed.

The length of the samples to be taken by the piston corer is determined by the amount of barrels 5 used. The barrels 5 are connected to each other via a barrel connection 6, which normally is a screwed or a pinned connection. Inside the barrels 5 a liner 7 is provided to maintain and hold the soil sample. At the bottom of the lowest barrel 5 a piston 8 is located that seals inside the liner 7. The piston 8 is connected via a piston wire 3 to the release mechanism 2 and thus to the lifting wire 1.

The piston wire 3 has a surplus length to accommodate for the re-coil in the lift wire 1 once the weight 4 of the LDPC is released and to accommodate for the free-fall height. After the LDPC has penetrated the soil the LDPC is retracted out of the seabed by pulling the lift wire 1. The soil sample is retained inside the liner 7 because the bottom of the lowest barrel 5 is sealed off by the piston 8 and the core catcher 11. This principle is also referred to as a Kullemberg type of sampling and is common practice in industry. Important for removal of the sample vertically while the barrel with sample moves up and down in the water lies in the fact that the barrel is sealed at bottom (at the cutting shoe) in order: to protect the sample due to vessel motion to prevent the sample being washed out; to retain the lateral support of the sample of the water inside the liner 7 to prevent the sample will collapse; and to vertically support the sample at the bottom once the piston at the top is removed to prevent that the sample falls out as the catcher 11 might not be strong enough to hold the entire weight of the sample.

When the LDPC 13 is retrieved to a deck of a floating vessel, the sample needs to be removed and the LDPC 13 needs to be prepared to take a new sample. In the prior art the removal of the sample is done with the LDPC in a horizontal position and for this purpose the LDPC 13 is transferred from a vertical to a horizontal position using a support construction, also referred to as stinger.

In the method of the invention a dedicated single handling unit 18 as shown in FIGS. 2A and 2B is used for retrieval of the LDPC and getting the samples therefrom without requiring any additional support structures. This has the advantage that the sample length can be freely chosen independent from the length of the vessel used for the soil sampling. Further the location of the handling unit 18 on the vessel is relatively uncritical; the handling unit of the invention allows that multiple locations can be used, over the stern, over the side or using a moonpool.

The handling unit 18 as shown in FIGS. 2A and 2B preferably has the dimensions, lifting points and connections of a standard sea freight container to make it easy transportable. It advantageously comprises a lifting device 31 to guide the lift wire 1 coming from a winch 20 on deck of the vessel 22, and to transfer the load acting on the lift wire 1 into the vessel strong points. The lifting device 31 is preferably designed such that it can be folded back into the container. The lifting device 31 is preferably arranged that it can boom in and out to move the LDPC 13 in and outwards.

FIGS. 2A and 2B show that a gimbal 21 is installed in the handling unit 18 for suspension of the FLPC 13. The gimbal 21 is used to compensate for the vessel 22 motions and keeps the FLPC 13 vertical while the vessel 22 is rolling and pitching. This minimizes the forces acting on the FLPC due to heave motion. In a section hanging over the side of the vessel 22, docking stations 29, 32 are located to store the barrels 5 and the weight stand 4 when not in use.

A first embodiment of the method according to the invention to remove the liner 7 is to disassemble the whole barrel assembly of the piston corer in separate barrel 5 parts while removing the liner 7 with the sample contained therein also in sections of pre-defined lengths.

When the LDPC 13 is retrieved to deck the sequence to remove the sample and to install a new liner to take the next sample is as follows, making first reference to FIG. 3.

Figure 4:
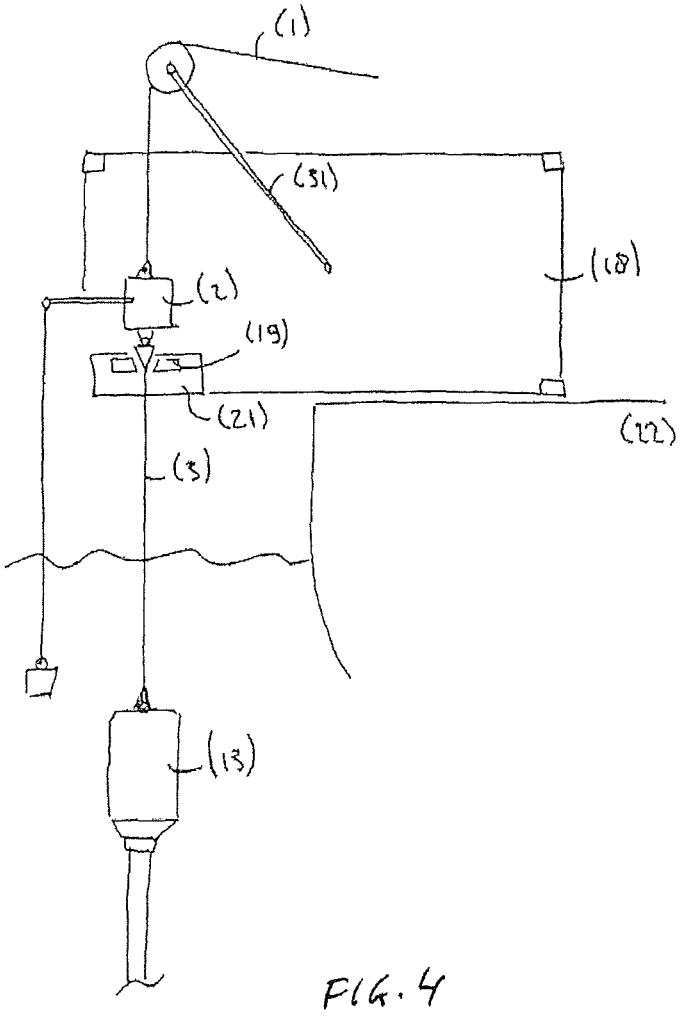
FIG. 4 shows suspension of the piston corer by the release mechanism of said corer.
Figure 5:
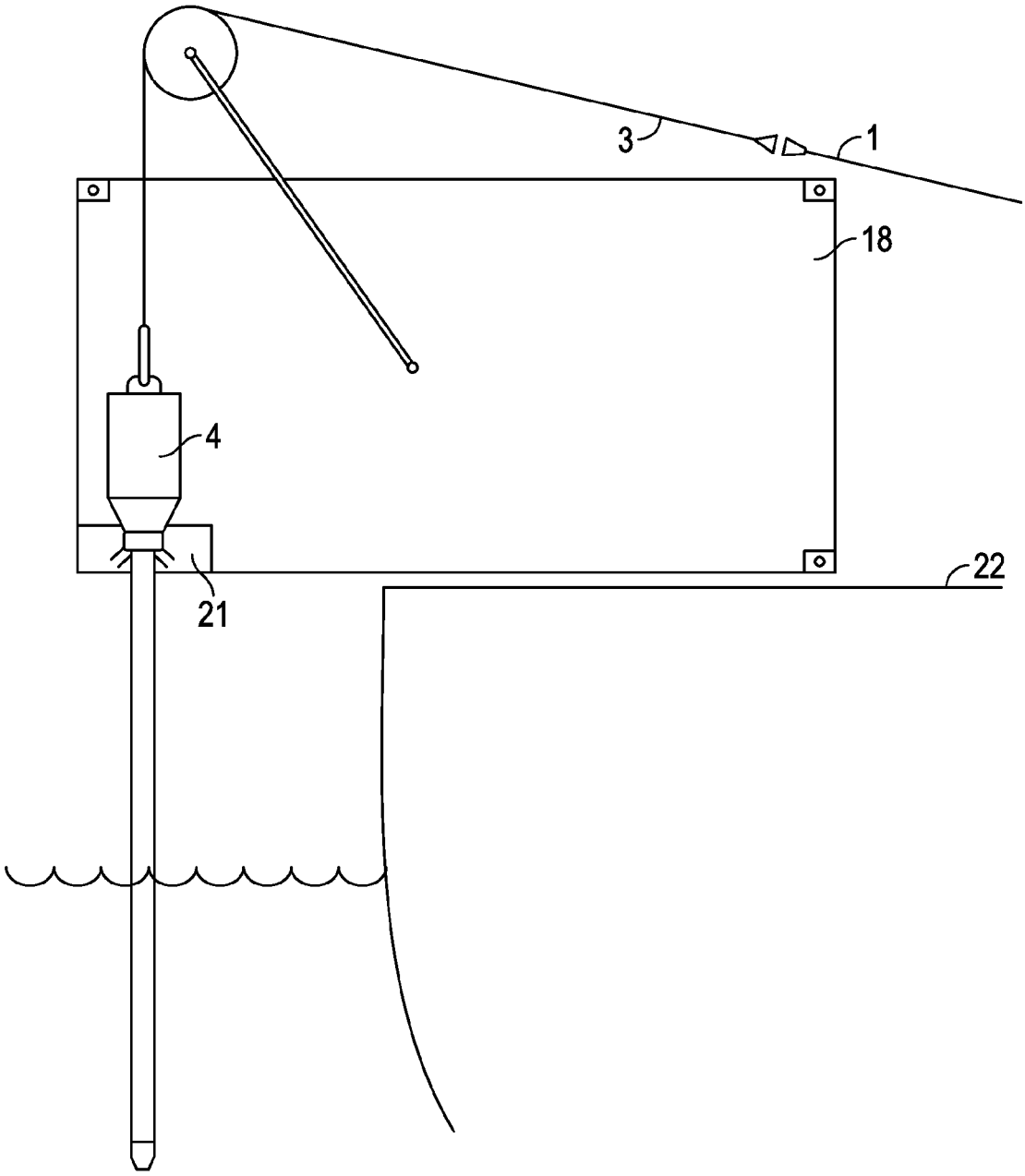
FIG. 5 shows suspension of the piston corer of FIG. 1 in a gimbal mounted in the handling unit of FIGS. 2A and 2B.

The release mechanism 2 will come up first and the LDPC assembly 13 is subsequently suspended in the U-shaped gimbal 21 using a catch plate 19 as shown in FIG. 4. The gimbal 21 can freely rotate and keep the LDPC vertical despite vessel 22 motions like roll and pitch. The release mechanism 2 and the release mechanism weight 10 are then removed, the lift wire 1 is connected to the piston wire 3 and the LDPC assembly is lifted and suspended in the gimbal as shown in FIG. 5.

Figure 6:
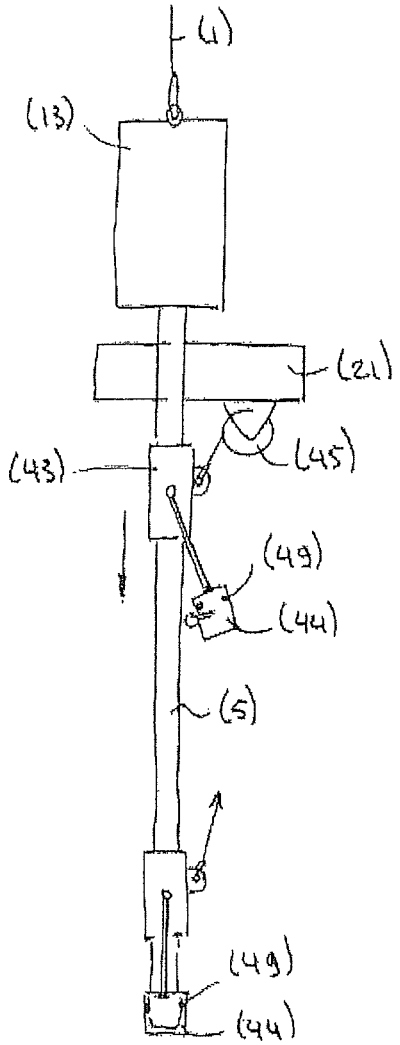
FIG. 6 shows the step of sealing the bottom of the piston corer of FIG. 1 after it is retracted from the sea bottom.

FIG. 6 illustrates that once the LDPC 13 is suspended a sealing device 43 with a frontal U-shaped opening is lowered using a winch 45. Once the sealing device 43 is at the cutting shoe 9 (see FIG. 1) a bucket 44 is shifted under the lowest barrel 5. The bucket 44 is provided with an internal seal 49, which is used by pulling the sealing device 43 up the bucket 44 to seal off the lowest barrel 5.

Figure 7:
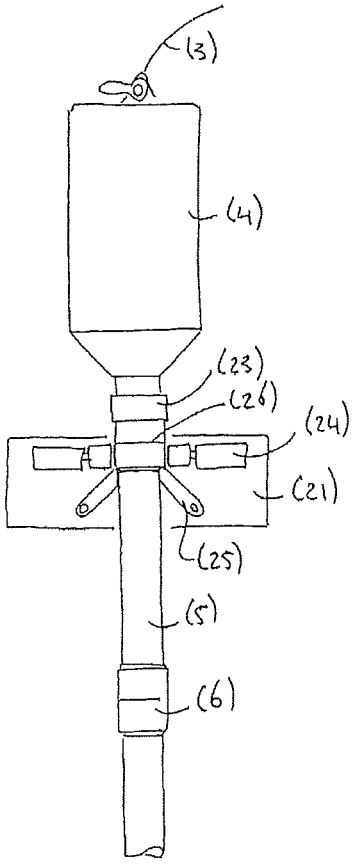
FIG. 7 shows in detail the suspension of the piston corer in the gimbal.
Figure 8:
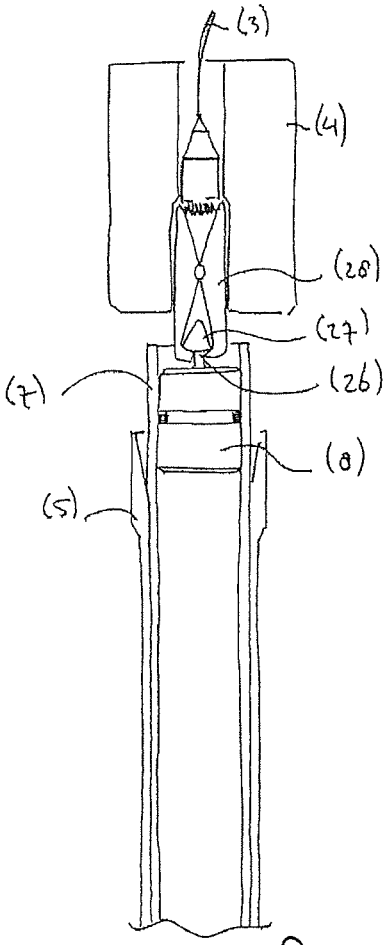
FIG. 8 shows the step of releasing the piston from the piston corer.
Figure 9:
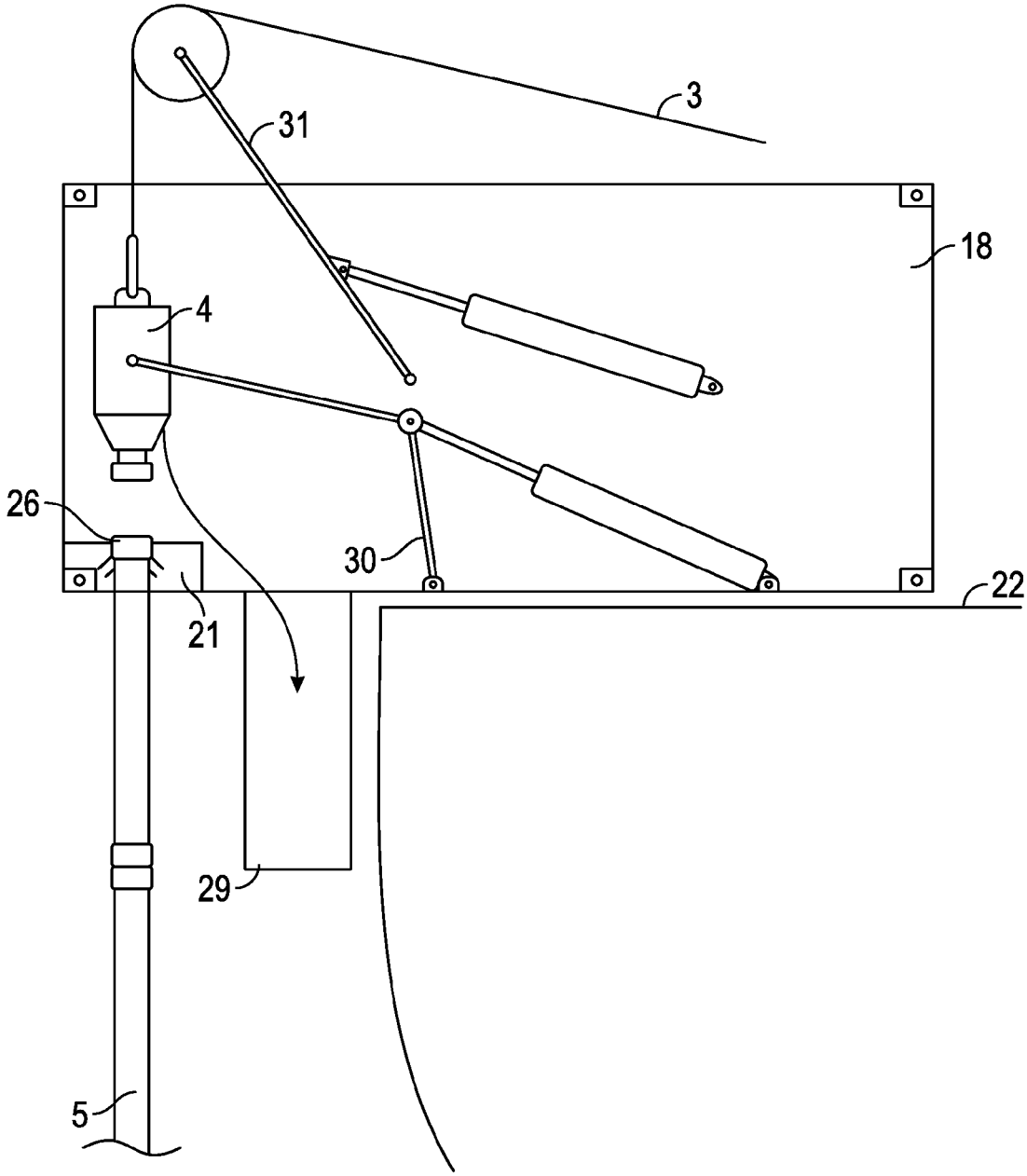
FIG. 9 shows movement of the weight stand from the piston corer to its docking station.

Making reference now to FIG. 7, it is shown that the LDPC 13 is suspended on the first barrel connection 26. The weight stand connection 23 is released and the weight stand 4 is removed by lifting it using the piston wire 3. In FIG. 8 is shown that the piston wire 3 is connected to the piston 8 using an overshot and spearhead type of connection 27. Once the weight stand 4 is lifted this connection 27 is released. The piston 8 remains in the liner 7 and the over-shot 28 is used to lift the weight stand 4. FIG. 9 depicts that the weight stand 4 is secured by means 30 to control the movement of the weight stand 4 in order to have a safe transition from the gimbal 21 to its docking station 29.

Figure 10:
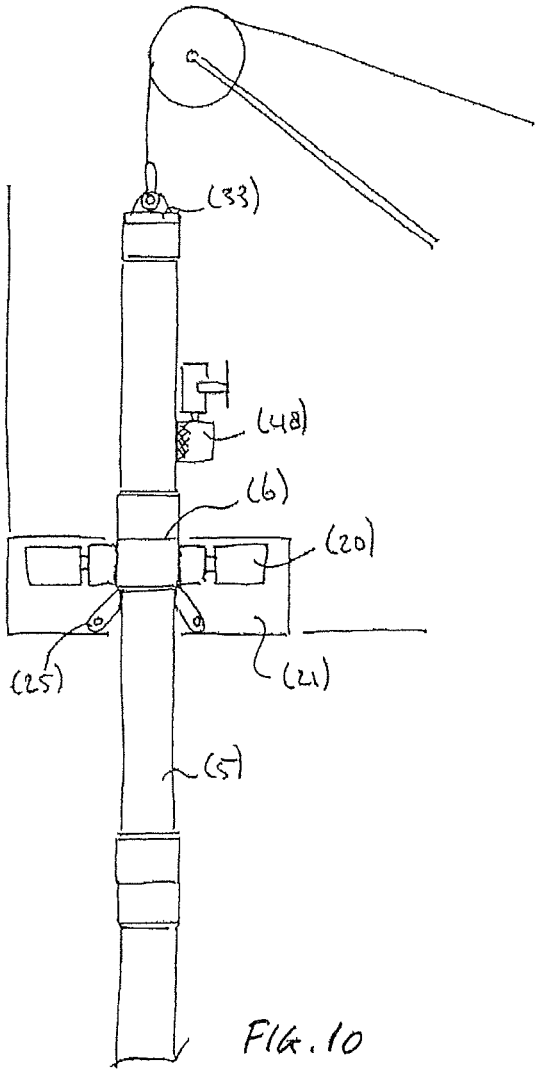
FIG. 10 shows the step of disconnecting a barrel from the top of the piston corer.

FIG. 10 shows that the remaining barrel assembly still suspended in the gimbal 21 is lifted using a lifting cap 33 to an elevation that the lower part of the barrel connection is at the same position as the clamp 20. The catching clamp 25 below the clamp 20 is used to take the vertical load and to suspend the barrel assembly. The clamp 20 is closed and in one embodiment a spinner 48 is used to rotate the barrel 5 above the clamp 20 in order to disconnect the barrel connection 6.

Figure 11:
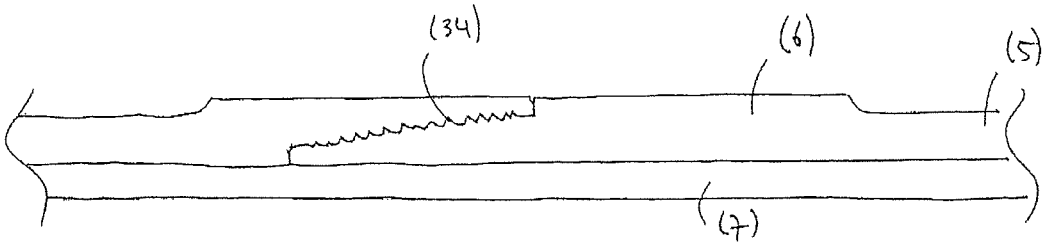
FIG. 11 shows the threaded connection between the barrels.
Figure 12:
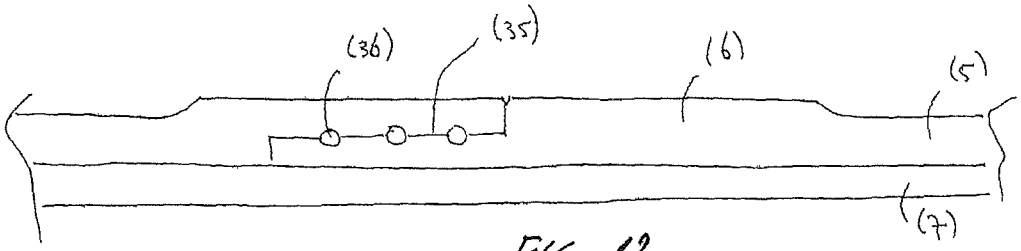
FIG. 12 shows an alternative connection between the barrels.

FIG. 11 shows that a threaded connection 34 between the barrels may be employed. Other connections can however be used as well, such as a pinned connection 35 as shown in FIG. 12 using pins and grooves 36 to connect the barrels.

Figure 13:
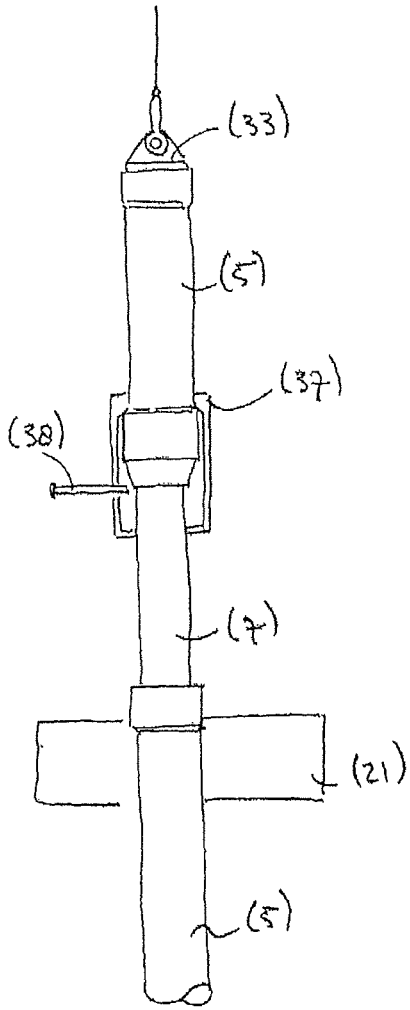
FIG. 13 shows cutting the liner of the barrel.

FIG. 13 shows that once the barrel connection 6 is disconnected the upper barrel 5 is lifted sufficiently to be able to mount a liner cutting device 37 to the barrel. In this embodiment a saw 38 is used to cut the exposed liner 7 but other means to cut the liner 7 can be used as well. Once the liner 7 is cut, the saw 38 will secure the liner 7 and soil sample inside the liner 7. The top part of the liner 7 remaining in the gimbal 21 will be capped using a cap 39 to protect the soil sample. The disconnected barrel with liner 7 and liner cutting device 37 is then placed in a stand 40 shown in FIG. 14, to remove the liner 7 from the barrel 5.

Figure 14:
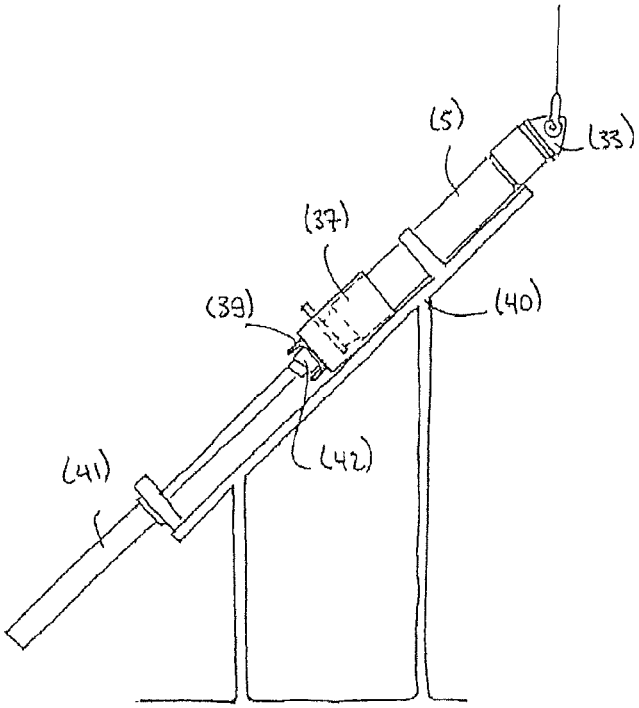
FIG. 14 shows cutting a liner in a stand.

Making further reference to FIG. 14 it is shown that the stand 40 is provided with an actuator 41. The upper barrel 5 removed from the LDPC is mounted in the stand 40 and the actuator, which is provided with a head 42 supporting a cap 39, is extended against the bottom of the cutting device 37. When the saw, or cutting blade 38 is removed the liner 7 and its content will rest on the cap 39 supported by the actuator head 42. Subsequently the cap 39 is unfolded to seal the bottom of the liner 7. The actuator 41 is thereafter retracted and the liner 7 slides out of the barrel 5.

Depending on the required length to store the samples the liner 7 is cut and capped again using the liner cutting device 37. The barrel 5 is removed from the stand 40 and stored in the barrel storage 32 and the capped liner sections 7 with the samples are stored in a conditioned storage space (not part of this invention). A next barrel from the suspended barrel assembly is lifted and removed according the same procedure, which is repeated until all barrels 5 are removed and all liners sections with the samples contained therein, stored.

In a second embodiment of the method of the barrel 5 is not disassembled in pieces but the outer barrel 5 remains intact while only the liner 7 is removed. Similar to what is done in the first embodiment of the method of the invention, the release mechanism 2 and the release mechanism weight 10 are removed (see FIGS. 3 and 4) and the LDPC is lifted in the gimbal 21 by lifting the unit by the piston wire 3 (see FIG. 5). Also similar to the operations according to the first embodiment of the method of the invention, a sealing device 43 is lowered (see FIG. 6) to seal off the lowest barrel 5 at its bottom.

Figure 15:
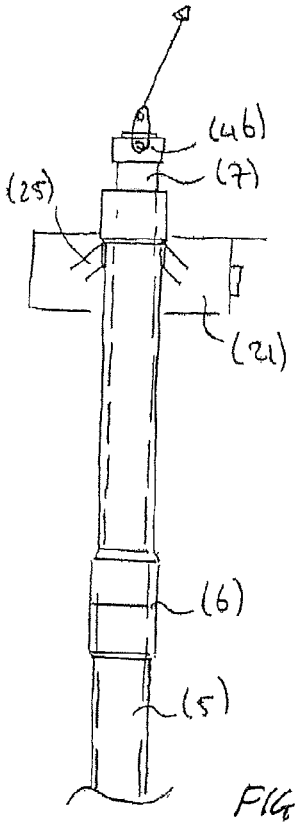
FIG. 15 shows an alternative embodiment of removing the liner from the piston corer.
Figure 16:
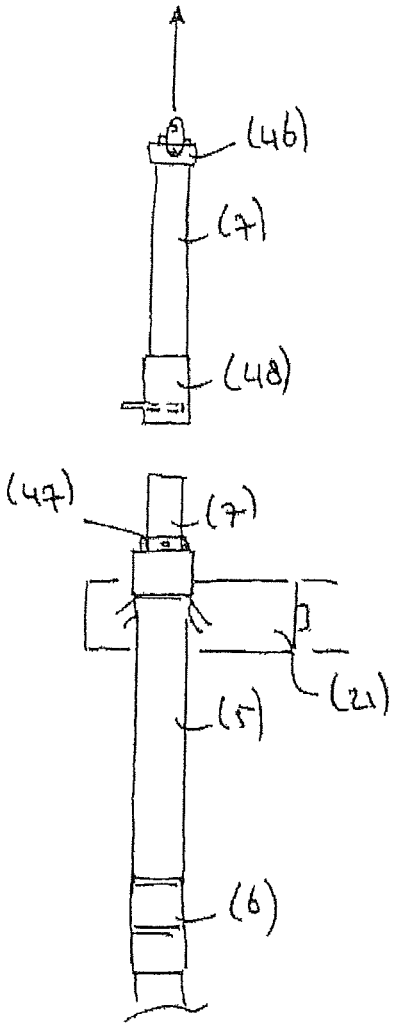
FIG. 16 shows an alternative method of cutting the liner.

The second embodiment of the method of the invention differentiates from the first embodiment in that according to FIG. 15 the liner 7 is pulled out of the barrel 5 using a liner clamp 46. The liner 7 remaining in the still suspended barrels is clamped and suspended using a second liner clamp 47, as is shown in FIG. 16. The removed part of the liner 7 is cut loose using a cutting device 48 clamp that is fixed to the section that is removed. The cutting device 48 cuts the liner 7 and seals the bottom of the liner section to prevent that the sample falls out. This procedure as illustrated with reference to FIG. 16 is repeated until the complete liner 7 with the sample contained therein is removed.

Although the invention has been discussed in the foregoing with reference to an exemplary embodiment of the apparatus of the invention, the invention is not restricted to this particular embodiment which can be varied in many ways without departing from the gist of the invention. The discussed exemplary embodiment shall therefore not be used to construe the appended claims strictly in accordance therewith. On the contrary the embodiment is merely intended to explain the wording of the appended claims without intent to limit the claims to this exemplary embodiment. The scope of protection of the invention shall therefore be construed in accordance with the appended claims only, wherein a possible ambiguity in the wording of the claims shall be resolved using this exemplary embodiment.

What is claimed is:

1. Handling unit equipped to acquire a sample from a seabed top layer by retracting and retrieving a piston corer suspended vertically from a floating vessel holding the sample from a seabed, and to remove the sample from the piston corer while the piston corer remains suspended vertically from the floating vessel, wherein the handling unit is a standalone unit arranged for mounting on the floating vessel and for retrieval of the sample from the piston corer while the piston corer remains suspended vertically from the floating vessel, and wherein the handling unit is provided with a gimbal for suspending the piston corer.

2. Handling unit according to claim 1, additionally comprising a container configured as a standard sea freight container.

3. Handling unit according to claim 1, wherein it comprises a lifting device.

4. Handling unit according to claim 3, wherein the lifting device is foldable out of and back into a container of the handling unit.

5. Handling unit according to claim 3, wherein the lifting device can boom in and out of the container to move the piston corer suspended therefrom in and outwards.

6. Handling unit according to claim 1, additionally comprising docking stations for storing barrels and a weight stand of the piston corer.

7. Handling unit according to claim 1, wherein the gimbal is provided with a catch plate for the piston corer.

8. Handling unit according to claim 1, wherein the gimbal has a winch for lowering a sealing device held within the container of the handling unit and move it down the barrels of the piston corer.

9. Handling unit according to claim 8, wherein a bucket is suspended from the sealing device, which bucket is provided with a seal for sealing of the lowest barrel of the piston corer.

10. Floating vessel provided with at least two handling units according to claim 1.

11. Method to acquire a sample from a seabed top layer comprising the steps of:

introducing a piston corer suspended from a floating vessel vertically into the seabed;

retracting the piston corer from the seabed; and removing the sample from the piston corer while the piston corer remains suspended vertically from the floating vessel; and wherein the sample is removed from the piston corer after the said piston corer is retracted from the seabed; and wherein the piston corer comprises a release mechanism with a weight, and when retracted from the seabed the piston corer is suspended by the release mechanism in a gimbal and said release mechanism and weight are removed from the remainder of the piston corer; and retrieving the piston corer on a deck of the floating vessel.

12. Method according to claim 11, wherein the piston corer comprises several barrels provided with a liner, wherein the barrels are one by one disconnected from each other, each barrel comprising a liner part which liner part is subsequently removed from the barrel.

13. Method according to claim 11, wherein the piston corer comprises several barrels provided with a liner, wherein the liner is integrally removed from the barrels and cut into separate liner parts.

14. Method according to claim 11, wherein a lift wire is connected to a piston wire of the piston corer to lift and subsequently suspend the piston corer from the gimbal once the release mechanism and weight are removed from said piston corer.

15. Method according to claim 11, wherein while the piston corer is vertically suspended, a sealing device is applied and lowered along the piston corer down to a its lowest barrel for sealing off said lowest barrel.

16. Method according to claim 11, wherein after vertically suspending the piston corer on an initially highest barrel connection, a weight stand connection of a weight stand is released and said weight stand is removed.

17. Method according to claim 11, wherein after removal of the weight stand, the remaining barrels that are vertically suspended are repeatedly lifted to a level that a top part of the second-highest barrel can be clamped, and the highest barrel can be disconnected from a second-highest barrel which then promotes to become the highest barrel that is subsequently disconnected from the then second-highest barrel.

18. Method according to claim 17, wherein after its disconnection from the second-highest barrel the highest barrel is lifted to accommodate mounting a liner cutting device to the barrel and cut the ex-posed liner.

19. Method according to claim 17, wherein the disconnected highest barrel with its liner and liner cutting device is placed in a stand to remove the liner from the barrel.

20. Method according to claim 19, wherein while the barrel is in the stand, repeatedly a cap is applied to the then lowest part of the barrel and unfolded to seal what is then the bottom of the liner, wherein repeatedly the liner cutting device is activated to cut and cap the then lowest section of the liner from the remainder of the liner in the barrel.

21. Method according to claim 20, wherein after the complete removal of the liner from the barrel in the stand, the said barrel is removed from the stand and stored in its docking station.

22. Method according to claim 11, wherein after removal of the weight stand, and while the piston corer is vertically suspended the liner is pulled out of the barrels of the piston corer and the remaining liner in the still suspended barrels is clamped and suspended using a second liner clamp.

23. Method according to claim 22, wherein repeatedly a preselected section of the pulled out liner is cut with a cutting device that is fixed to the section to be removed and which cutting device is used to seal off the bottom of said section to prevent any sample contained therein to fall out.

* * * * *